US007543613B2

(12) United States Patent
Adkins et al.

(10) Patent No.: US 7,543,613 B2
(45) Date of Patent: Jun. 9, 2009

(54) SYSTEM USING A CATENARY FLEXIBLE CONDUIT FOR TRANSFERRING A CRYOGENIC FLUID

(75) Inventors: Jimmie Dean Adkins, San Ramon, CA (US); David T. McDonald, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 416 days.

(21) Appl. No.: 11/303,216

(22) Filed: Dec. 16, 2005

(65) Prior Publication Data

US 2007/0074786 A1 Apr. 5, 2007

Related U.S. Application Data

(60) Provisional application No. 60/716,742, filed on Sep. 12, 2005.

(51) Int. Cl.
*B65B 37/00* (2006.01)

(52) U.S. Cl. ..... 141/231; 141/1; 441/4; 441/5

(58) Field of Classification Search ..... 141/1, 141/387, 82, 231, 388; 62/50.2; 441/3–5; 114/230.1; 405/224.2
See application file for complete search history.

(56) References Cited

U.S. PATENT DOCUMENTS

| | | | | |
|---|---|---|---|---|
| 3,332,446 | A | 7/1967 | Mann | |
| 3,828,565 | A | 8/1974 | McCabe | |
| 4,478,586 | A * | 10/1984 | Gentry et al. | 441/4 |
| 4,643,614 | A | 2/1987 | Laursen | |
| 4,718,459 | A | 1/1988 | Adorjan | |
| 5,036,890 | A | 8/1991 | Whaley | |
| 5,275,510 | A | 1/1994 | De Baan et al. | |
| 5,400,602 | A | 3/1995 | Chang et al. | |
| 5,803,779 | A * | 9/1998 | Horton, III | 441/4 |
| 6,003,603 | A | 12/1999 | Breivik et al. | |
| 6,434,948 | B1 | 8/2002 | Eide et al. | |
| 6,637,479 | B1 | 10/2003 | Eide et al. | |
| 6,779,949 | B2 | 8/2004 | Barras et al. | |
| 6,805,598 | B2 | 10/2004 | Goldbach | |
| 6,851,994 | B2 | 2/2005 | Boatman et al. | |
| 6,854,408 | B2 | 2/2005 | De Baan | |
| 6,886,611 | B2 | 5/2005 | Dupont et al. | |
| 6,915,753 | B1 | 7/2005 | De Baan | |

(Continued)

FOREIGN PATENT DOCUMENTS

EP 1 051 325 B1 11/2000

(Continued)

*Primary Examiner*—Timothy L Maust
*Assistant Examiner*—Jason K Niesz
(74) *Attorney, Agent, or Firm*—Alan W. Klaassen

(57) ABSTRACT

A system and a process are provided for transferring a cryogenic fluid such as liquefied natural gas between a floating transport vessel and a storage vessel. The fluid is transferred through at least one submerged/subsea/subsurface catenary flexible conduit, the conduits being configured to avoid damage from waves and abrasion or contact with the other conduits, the vessels, or other objects. A conduit transfer vessel is provided for storing the conduit in the water, delivering the conduit to each transport vessel, but standing off from the transport vessel during cryogenic fluid transfer, and then retrieving the conduit from the transport vessel, which greatly improves the safety of the cryogenic fluid transfer operations.

11 Claims, 5 Drawing Sheets

U.S. PATENT DOCUMENTS

| | | | | |
|---|---|---|---|---|
| 6,923,225 | B2 | 8/2005 | Poldervaart et al. | |
| 6,976,443 | B2 * | 12/2005 | Oma et al. | 114/144 B |
| 6,983,712 | B2 * | 1/2006 | Cottrell et al. | 114/230.15 |
| 7,174,931 | B2 | 2/2007 | Espinasse | |
| 2004/0011424 | A1 | 1/2004 | Dupont et al. | |
| 2004/0129195 | A1 | 7/2004 | Baan | |
| 2005/0145154 | A1 | 7/2005 | De Baan | |

FOREIGN PATENT DOCUMENTS

| | | | |
|---|---|---|---|
| EP | 1 308 384 | A2 | 5/2003 |
| EP | 1 462 358 | A1 | 9/2004 |
| WO | 90/00589 | A1 | 1/1990 |
| WO | WO 99/38762 | | 8/1999 |
| WO | 2004/081441 | A1 | 9/2004 |
| WO | 2004/090412 | A1 | 10/2004 |
| WO | 2005/043032 | A1 | 5/2005 |

* cited by examiner

SYSTEM USING A CATENARY FLEXIBLE CONDUIT FOR TRANSFERRING A CRYOGENIC FLUID

CROSS-REFERENCE TO RELATED APPLICATIONS

This application is a continuation of U.S. Provisional Application 60/716,742 filed on Sep. 12, 2005.

BACKGROUND OF THE INVENTION

The present invention relates to an offshore transport vessel unloading system. Transferring fluids, particularly cryogenic fluids, on the open ocean in unprotected locations offers particular hazards in terms of personnel safety and damage to the vessels or facilities involved the fluids which are transported in a transport vessel from a remote location may be delivered to either a tank in the offshore location, or by pipeline to a land-based receiving terminal. Offshore tank storage may either be floating or settled on the seafloor.

No commercially proven technology exists that allows LNG transfer in harsh open ocean conditions between a floating transport vessel such as a standard LNG Carrier (LNGC) and a floating storage vessel such as a Floating Liquefied Natural Gas (FLNG) vessel or a Floating Storage & Regas Unit (FSRU). An FSRU is a fixed asset near a market site, for storing LNG and converting the LNG to a vapor for delivery to on-shore facilities. An FLNG is a Floating LNG production vessel. It is a fixed asset at a production field, and converts natural gas to LNG and then stores it until it can be loaded onto an LNGC for delivery to market. For floating storage vessels to become technically and commercially viable, a reliable LNG transfer system is necessary, one that provides a high LNGC berth availability to ensure that gas delivery commitments can be met.

Conventionally, LNG transfer to/from a floating transport vessel is accomplished thru articulated hard-pipe loading arms, which require a relatively benign, sheltered location for the LNG transfer system to work. Virtually all operational LNG terminals are located onshore, in harbors or in waters that are sheltered from harsh ocean conditions. Requiring protected LNG transfer sites limits the number of potential sites for new terminals, and in many regions a suitable site simply is not available. On the other hand, public pressure is forcing LNG transfer facilities increasingly further offshore. For the US West Coast, few shallow water sites are available and the Pacific Ocean Meteorological & Oceanographic (metocean) conditions (sea states, currents & winds) complicate the problem and further limit the number of potential solutions.

Applying articulated loading arm technology in an open ocean location has been contemplated by many LNG Terminal Projects. In shallow water locations with milder metocean conditions, a gravity based structure (GBS) is a technically feasible solution. It basically serves as a breakwater, thus allowing loading arms to be used in a side-by-side berthing layout.

In deeper water applications, a floating storage vessel that is single point moored (SPM) allows the vessel to weathervane into the dominant metocean conditions, thus generally minimizing floating storage vessel motions. Loading arms have been proposed for side-by-side berthing arrangements. However, being able to predict the relative motions between the floating storage vessel and the floating transport vessel with the necessary high degree of certainty has proven to be difficult. Unlike a GBS, a floating storage vessel does not serve as a breakwater, and the tug boat operational problems are further compounded by the berthing approach layout. Additional concerns include damage to the floating transport vessel and floating storage vessel due to high relative motions of the vessels, and floating transport vessel breakout due to high loads on the mooring lines. All these issues combine to produce significant concerns over vessel berth availability of the various proposed offshore LNG terminal concepts, and thus exacerbate concerns with being able to meet gas delivery commitments.

Development work to date on new offshore LNG transfer systems has centered on aerial (in-air) systems, and recently work has started on floating hose systems. It has been found that these systems require the use of dedicated floating transport vessels and the resulting systems are overly complicated, often utilize too much new technology and are considerably expensive. Other 'in-water' bottom founded systems have been conceptualized, as well as a variety of platform based concepts, all of which utilize either loading arms or aerial hoses and have the same problems or concerns as stated above. Furthermore, most of these systems do not include LNG storage, which places them at a severe disadvantage.

More recently, the industry has renewed interest in floating hose based transfer systems and started development work. The appeal of a floating hose based system is that it mimics tandem ship-to-ship oil transfer systems, which are well understood and have a long, well proven history of safe, successful operation. Manufacturers have worked to develop a cryogenic floating hose based on a layered fabric (labyrinth) design with inner and outer wire reinforcements. Other designs utilize an insulated stainless "bellows-in-bellows" (BIB).

Several significant concerns exist for any floating hose system. By the nature of the design the hose floats at or near the high energy zone at the water surface. Thus the hose will experience significant wave loadings, movement and fatigue cycles, particularly if left in the water between LNG liftings. Hose manufacturers have only recently begun work to explore ways to retrieve/deploy the hose between liftings, but difficulties remain with all of these concepts. The typical manufacturing processes limit the hose sections to between 10 and 50 meters in length, perhaps 100 meters at the most. This necessitates that several flanged connections be incorporated into the hose string, which act as stiff points (stress risers). The flanged connections must further be insulated and sealed from heat and seawater ingress. A typical transfer system will include 2 to 3 LNG delivery hose strings, and possibly 1 vapor return hose string. Significant concerns exist over hose clashing, which is exacerbated by having several flanged connection in each hose string. Physical separation of the hose strings has been considered, but this limits hose movement which induces additional hard points and raises additional fatigue concerns. Finally, the means of lifting the hoses out of the water and connecting them to the floating transport vessel manifold is problematic and has yet to be defined.

EP1462358 describes an apparatus for mooring a tanker for transporting liquid natural gas. The apparatus is described as including a semi-submersible floating dock, a single point mooring system, and at least one rigid arm. Fluids from the ship are passed to the single point mooring system through flexible hoses. The flexible hoses are said to take a catenary form, and are further said to be either held above the water or partially in contact with the water.

U.S. Pat. No. 6,915,753 describes a similar assembly for passing fluid from one floating vessel to another.

U.S. Pat. No. 6,923,225 describes articulated hard-pipe loading arms for transferring liquid natural gas between a tanker vessel and a processing vessel.

U.S. Pat. No. 4,718,459 describes an underwater cryogenic pipeline system for transporting liquefied natural gas in underwater locations between an onshore production or storage facility and an offshore vessel.

US2004/0011424 teaches a system for transferring a fluid product between a carrying vessel and a fixed installation. A tubular conveying arrangement is described, comprising a connection device and a flexible transfer pipe connected to the installation. The free end of the flexible transfer tube is provided with handling means to move the free end between a connection position to the connection device and a disengaged storage position.

However, the current methods for transferring LNG in the open ocean have limited effectiveness. Aerial designs require dedicated floating transport vessels that are significantly modified versions of standard carriers, and are overly complicated and expensive. Floating hose systems, which lie in the wave zone, are subject to severe fatigue cycling as well as mechanical damage and abrasion from contact between hose strings. What is required is a LNG transfer system that provides safe operation, high berth availability, universal applicability, regardless of ship design, and conduit handling methods to substantially reduce conduit damage for offshore LNG transfer between floating vessels.

SUMMARY OF THE INVENTION

The present invention relates to a flexible conduit for transferring cryogenic fluid in a body of water. In one embodiment, the transfer takes place between two floating vessels, with the conduit being connected at each end to one of the floating vessels. In another embodiment, the transfer takes place between a fixed liquid transfer system in a body of water and a floating vessel. The flexible conduit is substantially submerged in the water, and is further constrained to minimize contact with the bottom of the body of water, the floating vessels or the fixed system which are involved in the transfer of fluid, or other conduits which are involved in the transfer. In one embodiment, each conduit in the present system is suspended in the water in such as way as to assume a catenary configuration.

Accordingly, a system is provided for transferring a cryogenic fluid in a body of water, the system comprising a flexible conduit supported at a first end and at a second end and having a catenary configuration, wherein the conduit is substantially submerged in the body of water.

In a separate embodiment, the present invention provides a system for transferring a cryogenic fluid, comprising: a pipe spool having a connection means for attaching to a floating transportation vessel; at least one conduit having: a first end which is swivably connected to the pipe spool; and a second end which is swivably connected to a connection means for attaching to a floating storage vessel.

Further to the invention, a cryogenic fluid delivery system is provided, the system comprising: a cryogenic fluid floating transportation vessel; a cryogenic fluid floating storage vessel; a pipe spool having a first connection means for attaching to the transportation vessel; and at least one conduit having: a first end which is swivably connected to the pipe spool; and a second end which is swivably connected to a second connection means for attaching to the storage vessel.

Further to the invention is a process for transferring a cryogenic fluid between a transportation vessel to a storage vessel, comprising: providing a cryogenic fluid transfer assembly having: at least one pipe spool supported on a floating support vessel; at least one conduit having a first end which is swivably connected to the pipe spool, and a second end which is swivably connected to a floating storage vessel; and transferring the at least one pipe spool to a cryogenic fluid transportation vessel, and connecting the pipe spool to a connection means comprising a quick release connection.

In an embodiment of the invention, the conduit in a flexible catenary hose.

One object of the present invention is to provide a system and a method for transferring a cryogenic fluid such as LNG in the open ocean. Another object of the present invention is to provide a system comprising a flexible conduit for transferring a cryogenic fluid in the open ocean, while minimizing the stresses placed on the flexible conduit during its use. Thus, in one embodiment, the flexible conduit connects to the midship manifold of the transport vessel, optionally through a pipe spool, for transferring LNG to and from the vessel.

DETAILED DESCRIPTION OF THE INVENTION

Figure 1:
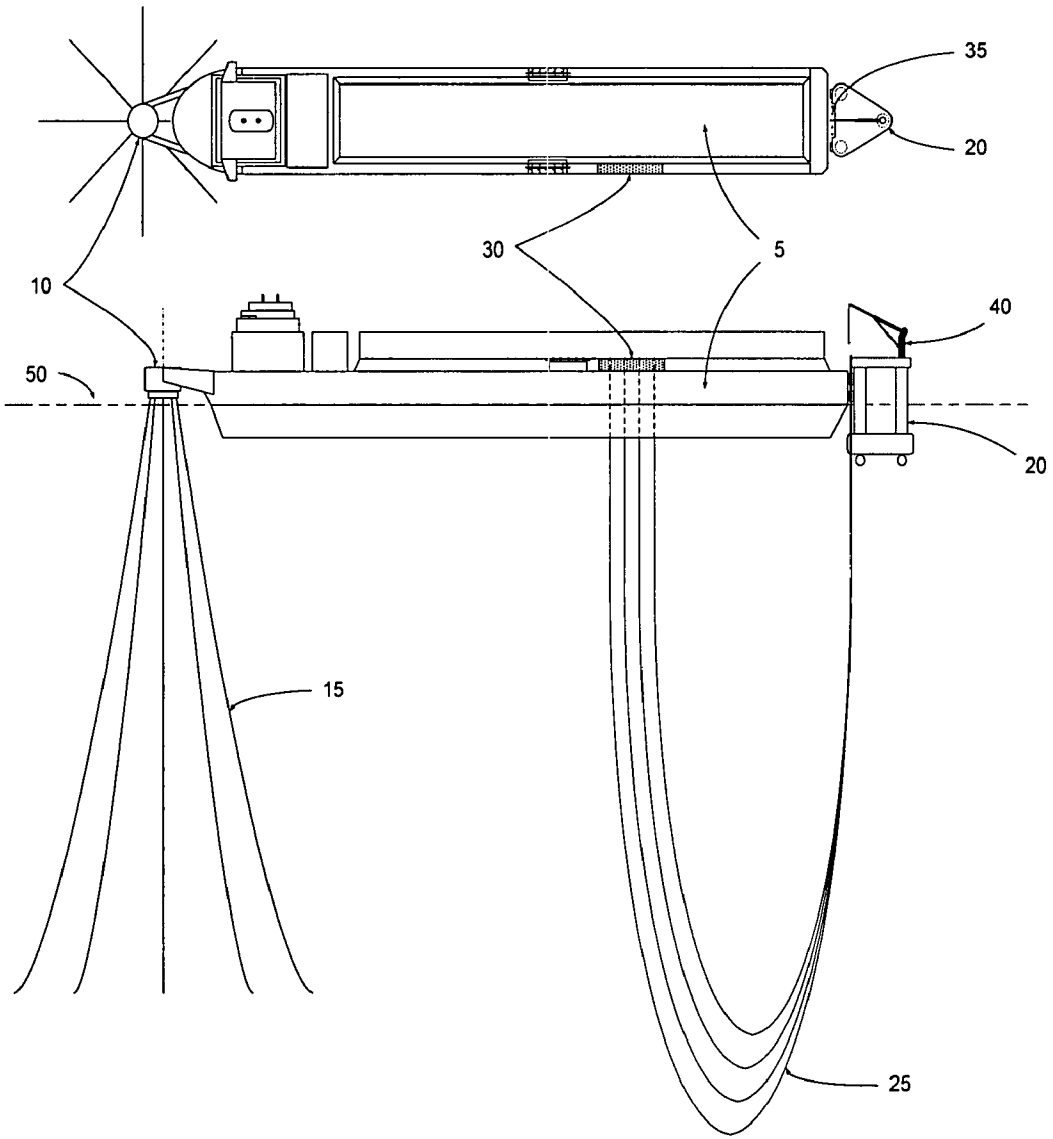
FIG. 1 illustrates an embodiment of the invention, showing a cryogenic fluid floating storage vessel with attached conduit, and with an associated conduit transfer vessel for supporting the conduit.

The present invention is directed to a flexible conduit system comprising a flexible conduit. In this disclosure, the terms conduit means, conduit, pipe and hose are used interchangeably in reference to the conduit means of this invention. For purposes of this disclosure, these terms are deemed to be equivalent, unless otherwise indicated.

For purposes of this disclosure, a cryogenic fluid is a liquid phase fluid which must be maintained at sub-ambient temperatures (i.e. temperatures less than 25° C.) and/or at a super-ambient pressure (i.e. at a pressure greater than 15 psia) to remain in the liquid phase. Liquefied natural gas (LNG) is a cryogenic fluid comprising predominately methane with decreasing amounts of C2+ hydrocarbons. Liquefied heavy gas (LHG) is a cryogenic fluid comprising predominately C2+ hydrocarbons. Liquefied petroleum gas (LPG) is a cryogenic fluid comprising predominately C3+ hydrocarbons. Any or all of these fluids, when maintained in the cryogenic state, can be transferred in the process and in the system of this invention.

In the process of the invention, a cryogenic fluid is transferred between floating vessels designed for handling, processing and, or transporting the fluid, in sufficiently deep water to permit use of the catenary conduit of this invention.

In one embodiment, one of the vessels is a transportation vessel for transporting the cryogenic fluid from one location, such as the location where the fluid is prepared, to a second location, such as near to or connected with a market site for the fluid. A second floating vessel may be a floating storage vessel for the fluid, located at or near the site where the cryogenic fluid is prepared, or at or near the site where the cryogenic fluid is delivered to a market. Further, the second floating vessel may have on-board facilities for converting the fluid from the liquid phase to the vapor phase (i.e. by regasification), and optionally for preparing the vapor phase fluid for passage into a delivery system such as a pipeline for transport to a market location. Methods for regasifying a cryogenic fluid are well known. In another embodiment, the second vessel may be primarily a transfer vessel for transferring LNG from a floating vessel to on-shore storage and/or regasification facilities.

In a separate embodiment, the cryogenic fluid is transferred between a floating transportation vessel and a fixed deepwater assembly, for delivering the cryogenic fluid to a land-based facility. The fixed assembly for delivering the cryogenic fluid is located in sufficiently deep water to permit use of the catenary conduit of this invention, and is anchored to the bottom of the seafloor to make it sufficient stationary and robust for locating in the sea.

The flexible conduit system of the present invention will connect to any connection means provided for this purpose on each of the vessels or the fixed deepwater assembly. For example, a floating transport vessel for transporting a cryogenic fluid is generally equipped with a midship manifold for use in off-loading the fluid. The present system permits the flexible conduit system to connect directly into this midship manifold without requiring the extensive specialized structures needed with conventional off-loading systems. In one embodiment, the flexible conduit connects directly to the midship manifold. In another embodiment, the flexible conduit system comprises at least one flexible conduit, and a connection means which is connected to one end of the flexible conduit and further connected to the vessel, the connection means comprising one or more connectors, connected together in any order, and selected from the group consisting of a swivel connector, an emergency release system, a pipe spool and a quick connect/disconnect coupling.

To provide a means of safety to the vessel, the manifold provided on the transport vessel for off-loading the cryogenic fluid does not generally extend beyond the hull of the vessel. Accordingly, the present system comprises a pipe spool for attaching the flexible conduit to the vessel, while maintaining the end of the conduit in a generally vertical orientation, such that the conduit is permitted to hang from the pipe spool in a catenary configuration, without physically contacting the vessel along the length of the conduit. Thus, the pipe spool reduces the amount of abrasion damage or bending stresses to the flexible conduit. When the conduit is not in use and is being moved from its connection on the storage or transport vessel to the conduit transfer vessel, the pipe spool may remain connected to the conduit. Alternatively, the pipe spool may be stored separately from the conduit on one of the vessels involved in the present process.

Among Other Factors

Conventional LNG transfer hoses float on the surface of water, whether empty or being used to transfer LNG. Among other factors, the present invention is based on the discovery that weighting an LNG delivery hose, which is suspended from each end such that the hose is substantially submerged in a catenary configuration during transfer of LNG in a body of water, minimizes the affects of the surface wave zone on the hose, allows the hose to be stored in the water between LNG transfers, permits transfer of the cryogenic fluid using the midship manifold of the floating transport vessel and reduces the amount of specialized hardware required for transferring LNG and other cryogenic fluids. Further to the discovery is that a conduit assembly comprising a multiplicity of flexible conduits, each suspended from the two ends and weighted to permit the conduit to be substantially submerged in a catenary configuration, can be used in close proximity to each other without damaging each other through contact.

In an embodiment of the invention, a cryogenic fluid such as a Liquefied Natural Gas (LNG) is transferred between a floating transport vessel such as a Liquefied Natural Gas Carrier (floating transport vessel) and a floating storage vessel, such as a Floating Storage & Regas Unit (floating storage vessel). A conduit transfer vessel is utilized to support the first end of the conduit between transfers and is "parked" at the stern of the floating storage vessel. In this position the hoses hang in a relatively tight, but deeper catenary and move in unison with the floating storage vessel and the conduit transfer vessel. Prior to arrival of the floating transport vessel, the conduit transfer vessel moves away from the floating storage vessel with the hoses, which allows the floating transport vessel to tandem moor to the floating storage vessel by a conventional hawser system. The conduit transfer vessel moves to the floating transport vessel and moors along side at the midship manifold. Once in place a crane on the conduit transfer vessel lifts a hose off a hanger rack and transfers it to the floating transport vessel where it is guided into the correct position and the quick connect/disconnect coupling (QC/DC) locks the hose onto the floating transport vessel manifold. This process is repeated until all hose strings (typically 3 to 4) are connected and secured. At that point cool-down of the system commences and the conduit transfer vessel backs away from the floating transport vessel to allow LNG transfer and vapor return operations to proceed.

Once LNG transfer operations are completed, the conduit transfer vessel moves back and moors into position near the floating transport vessel, the first hose string is removed, then hung back and secured into position on the conduit transfer vessel hose rack. Once all hoses have been removed and secured, the conduit transfer vessel backs away from the floating transport vessel, which un-berths and departs, at which point the conduit transfer vessel moves back into the "parked" position on the stern of the floating storage vessel.

Throughout all operations the hoses remain in a catenary configuration, and are essentially aligned in the same vertical plane. The hoses are different lengths so that a suitable separation distance is maintained between the hoses, particularly at the bottom, or low point of the catenary. This configuration essentially eliminates concerns over the clashing of hoses as they will remain parallel as they move thru the water, e.g. they remain aligned as they follow the motions of the floating storage vessel, the conduit transfer vessel and the floating transport vessel.

During transfer of the cryogenic fluid, each hose is in the vertical position, which reduces the wave loadings on it compared to a floating hose. Where the upper end of the hose passes thru the wave zone (and is also handled by the crane) the hose could be stiffened to further alleviate these concerns. Alternately, a hard pipe section could be utilized at the upper end of the hose to eliminate any fatigue and handling concerns.

In the connected position to the floating transport vessel, the hose is located in the vertical, outboard of the floating transport vessel rail. This dictates that a 90 degree pipe spool be utilized to connect the hose to the floating transport vessel manifold. This pipe spool is typically attached to the hose and carried with the hose on the conduit transfer vessel. The floating transport vessel may optionally be fitted with hard points to support the weight of the pipe spool and hose, and stabbing guides to facilitate alignment of the pipe spool to the manifold flange. Alternately, a temporary alignment and support skid may be utilized to support the conduit loads and to facilitate alignment of the pipe spool to the manifold flange. Once aligned, the QC/DC would latch onto the manifold flange, minimizing the need for operator intervention.

An Emergency Release System (ERS) may be an element of the connection means. This places the ERS in the vertical run outside the floating transport vessel rail so that it simply drops the hose into the water if actuated. The hoses would be designed with slight positive buoyancy so as to 'ride' out of the water in this free-floating state. The hoses may be connected together with short cables, and a tag line provided back to the conduit transfer vessel so that the hose bundle can be winched away from the floating transport vessel. This allows the floating transport vessel to depart under the emergency conditions while minimizing the potential for damage to the transfer hoses.

Reference is now made to an embodiment of the invention illustrated in FIG. 1. In FIG. 1, a cryogenic fluid storage vessel (5) is moored by a single point mooring turret (10). The turret is anchored to the sea floor via anchor lines (15). A conduit transfer vessel (20), which is positioned near the storage vessel (5), supports one end of a multiplicity of conduits (25). The other end of the conduit (25) is supported on the storage vessel (5). According to the invention, the conduits (25) are for use in delivering a cryogenic fluid to (or from) the storage vessel (5).

Cryogenic Catenary Conduit

FIG. 1 illustrates a conduit assembly comprising a multiplicity of flexible catenary conduits (25), each supported at one end by a support means (30) on a storage vessel (5) and further supported at the other end by a support means (35) on a conduit transfer vessel (20). In this way, each flexible conduit, having a catenary configuration is substantially submerged in the body of water below mean water level 50, with one end of the conduit being supported out of the water by one of the vessels and the other end of the conduit being supported out of the water by another of the vessels. Any number of conduits, including a single conduit, is encompassed within the broad specification of this invention. In actual practice, it is desirable to have at least one cryogenic liquid delivery conduit (e.g. 3 delivery conduits) and at least one vapor return conduit. The cryogenic liquid delivery conduit is useful for transferring a cryogenic liquid between a transport vessel and a storage vessel. As the liquid is transferred from one vessel to another and fills a storage tank in the receiving vessel, the vapor which is displaced from the vapor space in the storage tank is transferred back to the other vessel in the vapor return conduit. The conduits provided for transferring the cryogenic fluid are designed for a range of pressures. In one embodiment, the conduit system is provided for transferring a cryogenic fluid at a pressure of up to 175 psig. In another embodiment, the conduit system is provided for transferring a cryogenic fluid at a pressure of greater than 175 psig.

The embodiment illustrated in FIG. 1 illustrates three cryogenic liquid delivery conduits and one vapor return conduit. An illustrative cryogenic liquid delivery conduit has an inside diameter of 12 to 20 inches, and comprises an interior core of two or more concentric flexible metallic bellows, wherein each annulus is evacuated of nearly all fluids to create a vacuum, thus providing insulation to the assembly. The metallic bellows core assembly is covered by a carcass of waterproof material (with embedded strands or ropes for axial reinforcement and strength) for protecting the conduit from seawater and from mechanical damage and abrasion during contact with other objects. While the conduit is generally designed to withstand wave motion without failure, it is a feature of the present invention that the effects of wave motion are further reduced by the generally vertical catenary configuration of the conduit near the water surface and the alignment of each of the conduits relative to the other conduits in the assembly. Thus, the conduit assembly of the invention can be moved through its full useful range from a conduit transfer vessel (20) to a transport vessel in either tandem or side-by-side configuration without an individual conduit contacting the other conduits in the assembly. The length of the conduit which can be used in the practice of the invention is limited only by the lengths required to minimize the stresses in the conduit itself and the maximum length which is permitted by the manufacturing process in which the conduit is made. In one embodiment, the conduit is continuous from end to end, without flanges anywhere along its length. In another embodiment, the conduit comprises shorter sections of hose as described, with the sections being connected with flange or hard junction connections to form the desired length for use in the fluid transfer process.

It is desirable to always maintain each conduit in a catenary configuration to the extent possible, since deviations from this configuration will add stress to the conduit and potentially shorten its useful life. According to the invention, each of the conduits in the delivery conduit assembly assumes a catenary configuration, with each end of the conduit being supported by a support means, and with the submerged length of the conduit between the ends being permitted to hang in a generally vertical plane under the attraction of gravity. Conventional conduits tend to be buoyant, and some will be expected to float. Therefore, in one embodiment of the invention, the flexible conduit is selectively weighted such that the conduit is substantially submerged in the body of water during transfer of the cryogenic fluid through the conduit. The conduit may be uniformly weighted along its length, or a portion thereof, to achieve the desired buoyancy to maintain the catenary configuration. Alternatively, the conduit may be weighted at the bottom of the catenary to compensate for buoyancy effects. The catenary hose, therefore, retains its shape during use in transferring the cryogenic fluid, reducing the detrimental effects of any bending stresses to the conduit.

The conduit of the invention may be further weighted such that each end of the conduit can be easily retrieved should the end of the conduit become free of any connection or support. In one embodiment, the conduit can be selectively weighted and designed, such that, if released into the body of water without connection or external support, it will assume a vertical catenary configuration, with the ends floating on the surface of the body of water and the remainder of the conduit hanging in vertical configuration below the floating ends.

The conduit maintains a catenary configuration while remaining substantially submerged in the body of water. In one embodiment, only the ends of the conduit are exposed above the water, and the conduit enters the wave zone in essentially a vertical orientation. In another embodiment, greater than 60%, and preferably greater than 75% of the conduit hangs below the water's surface. Conduit lengths of 300 feet or greater are expected to be useful for most applications.

Cryogenic Fluid Floating Storage Vessel

In FIG. 1, each conduit is supported by attachment to a connection means (30) on the cryogenic fluid floating storage vessel (5). Storage vessels of this type are identified by one of a number of terms, such as a Floating Storage & Regas Unit (FSRU), a Floating Liquefied Natural Gas (FLNG) ship, or a Floating Production Storage and Offloading (FPSO) ship, or a Floating Storage and Offloading (FSO) ship. In one embodiment, each conduit is supported on the storage vessel, and passes thru a hawse pipe located close to the midship manifold and thru a double wall ballast tank. The hawse pipe arrangement mitigates concerns with wave loadings on the conduit as it exits the storage vessel well below the wave zone. Use of the hawse pipe configuration also provides an opportunity to install articulated loading arms on the storage vessel. This allows side-by-side LNG transfers should periods of mild metocean conditions exist. This configuration also provides a back-up system should the cryogenic liquid transfer system of this invention be unavailable.

The connection means for attaching the conduit to the storage vessel may be located on the midship manifold, which is intended for delivering the cryogenic liquid to the various tanks in the storage vessel. Any connection means with which the storage vessel is supplied is suitable for use in the present invention. Example connection means which are useful include a flanged connector or a quick connect/disconnect connector. An in-line swivel is desirably provided on each hose to allow the hose to rotate, thus eliminating any torsional concerns imparted in the hose during connection, during use, or during transfer from one vessel to another.

The storage vessel is generally anchored at, for example, a single point mooring anchorage, near the market location for liquefied natural gas. As such, the storage vessel is generally equipped with means for the cryogenic liquid to be gasified (converted from a liquid to a vapor phase) in a regasification facility installed on the storage vessel prior to delivery to a receiving station for distribution to one or more natural gas customers. Alternatively, the storage vessel can be equipped with means for delivering liquefied natural gas to a market location, to another land-based or sea-based transport vessel, to a refinery, to a power plant or to a gasification facility for converting the cryogenic liquid into vapor.

Conduit Transfer Vessel

In one embodiment of the practice of the invention, the conduit is permitted to hang at both ends from a transfer vessel. Prior to attachment, the transfer vessel moves the first end of the conduit into place on one vessel and moves the second end of the conduit into place on a second vessel, in preparation for transferring the cryogenic fluid from one vessel to another.

In another embodiment, the conduit remains connected to one vessel (normally the floating storage vessel) during a sequence of fluid transfer operations. In this case, one step in the process of the invention involves attaching the free end of the conduit to a second vessel (normally the floating transport vessel) for transfer of the fluid from one vessel to another. As shown in FIG. 1, the conduit is supported at its first end by the storage vessel (5). A conduit transfer vessel (20) is further positioned near the storage vessel (5) for supporting the conduit with its pipe spool at its second end (35). The specific method for supporting the conduit is not critical, so long as the conduit, with possibly a pipe spool attached thereto, is firmly held in place, such that wave induced fatigue damage, mechanical damage, abrasion damage, or other damage due to contact with other objects, is minimized. The conduit transfer vessel may be a semi-submersible vessel, particularly designed for the purpose described. Otherwise, the conduit transfer vessel may be any other form of service boat, offshore supply vessel or other type of vessel with sufficient stability and capacity.

In the practice of the invention, a crane (40) will be used for lifting the second end of the conduit from the conduit transfer vessel to the transport vessel. The crane may be located on the transport vessel, on the conduit transfer vessel, or on a separate vessel. In order to maintain a safe operation while permitting a wide range of different transport vessels to unload LNG in the use of the invention, the crane is preferably positioned on the conduit transfer vessel (20).

Cryogenic Fluid Floating Transport Vessel

Figure 2:
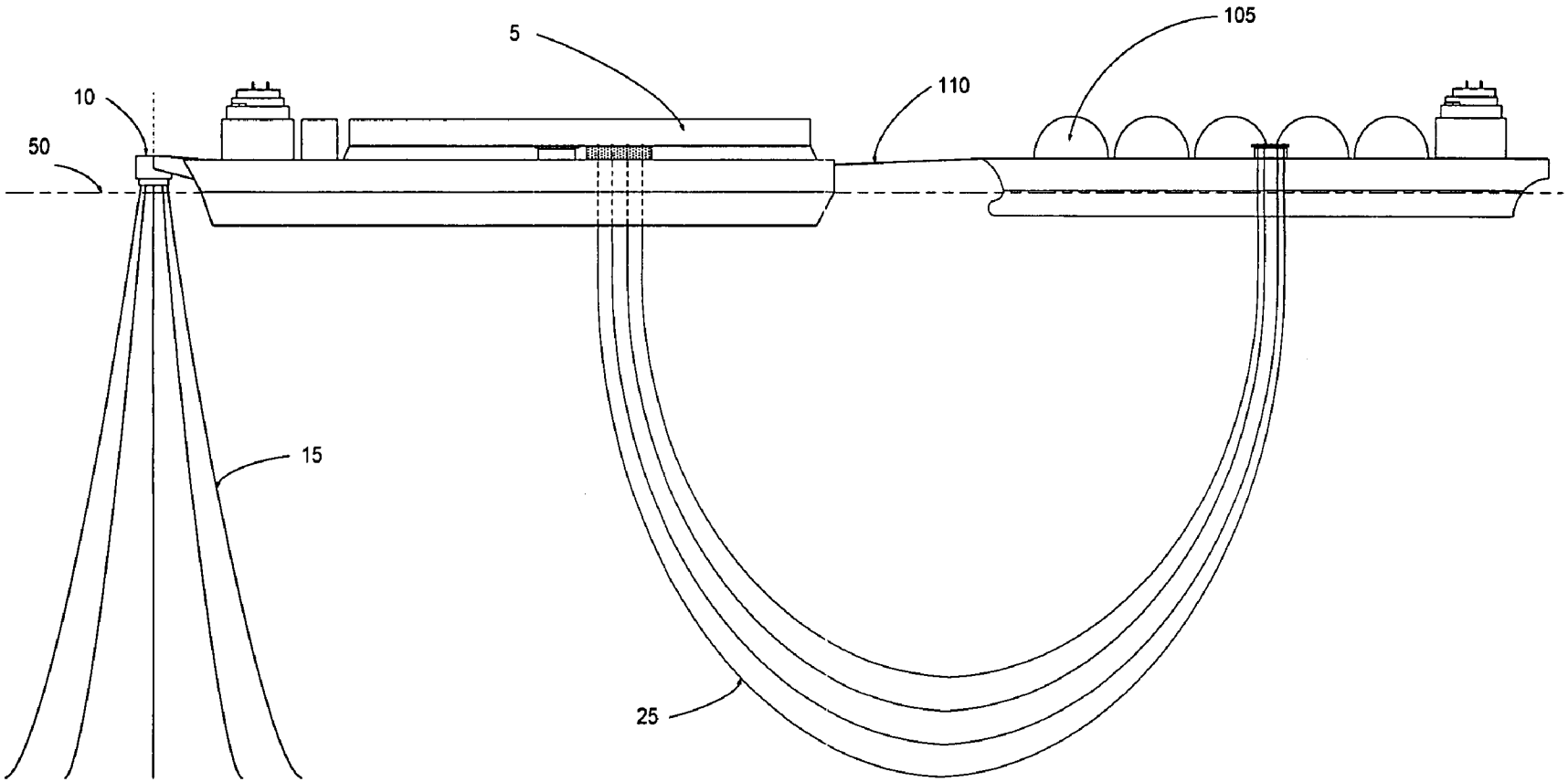
FIG. 2 illustrates a cryogenic fluid floating storage vessel and a cryogenic fluid floating transport vessel in tandem ship-to-ship arrangement, with conduit in place for transferring a cryogenic fluid from the transport vessel to the storage vessel or from a storage vessel to a transport vessel.

FIG. 2 illustrates a cryogenic fluid floating transport vessel (105) in tandem ship-to-ship arrangement with a storage vessel (5). The cryogenic fluid storage vessel (5) is moored by a single point mooring turret (10), which is anchored to the sea floor via anchor lines (15). The floating transport vessel may be any sea-going vessel equipped to transport a cryogenic fluid, such as a liquefied natural gas or liquefied petroleum gas, from a remote site to the storage vessel. The transport vessel is generally equipped with a midship manifold and connection means for connecting each conduit in the conduit assembly for transferring the cryogenic liquid, such as liquefied natural gas. In the practice of the invention according to the embodiment illustrated in FIG. 2, the transport vessel is attached to the storage vessel (5) by a hawser (110). Such an arrangement permits the storage vessel and the transport vessel to move independently to some degree in response to wave action and the wind, while maintaining the general tandem configuration.

After the transport vessel is positioned and secured to the storage vessel, the conduit transfer vessel moves into place and transfers each conduit from the support position on the transfer vessel to the connection means on the transport vessel. When all of the conduits (25) are connected to the transport vessel, the conduit transfer vessel is moved away from the transport vessel. The fact that the conduit transfer vessel does not remain attached to the transport vessel during cryogenic fluid transfer, but moves a distance away, greatly improves the safety of the cryogenic fluid transfer operations.

Connection Means for Attaching Conduit to Transport Vessel

During fluid transfer, the flexible conduit system is connected at one end to a floating vessel and at the other end to a floating vessel or to a fixed deepwater connection means for transferring the fluid to (or from) on-shore facilities. Each end of the flexible conduit may be connected directly to the transfer manifold provided on each vessel. Alternatively, a connection means may be included in the connection between a vessel and one end of the conduit. Thus, the flexible conduit system comprises a connection means which is connected to one end of the flexible conduit and further connected to one of the vessels, the connection means comprising one or more connectors, connected together in any order, and selected from the group consisting of a swivel connector, an emergency release system, a pipe spool and a quick connect/disconnect coupling.

In the process of transferring cryogenic fluid, the connection means is attached at one end to the flexible conduit and at the other to the vessel, from (or to) which the cryogenic fluid is transferred.

The transfer manifold refers to the means provided with the vessel, through which and with which the cryogenic fluid is transferred while the vessel is loading or unloading its cargo. Often the transfer manifold comprises a flanged connector for connecting to the conduit system. The vessel may be designed with a transfer manifold located anywhere within the vessel. A common transfer manifold is termed the mid-ship manifold. In general, the flexible conduit system provides a connection means for attaching the flexible conduit to the transfer manifold, regardless of the design or location of the manifold.

Figure 3:
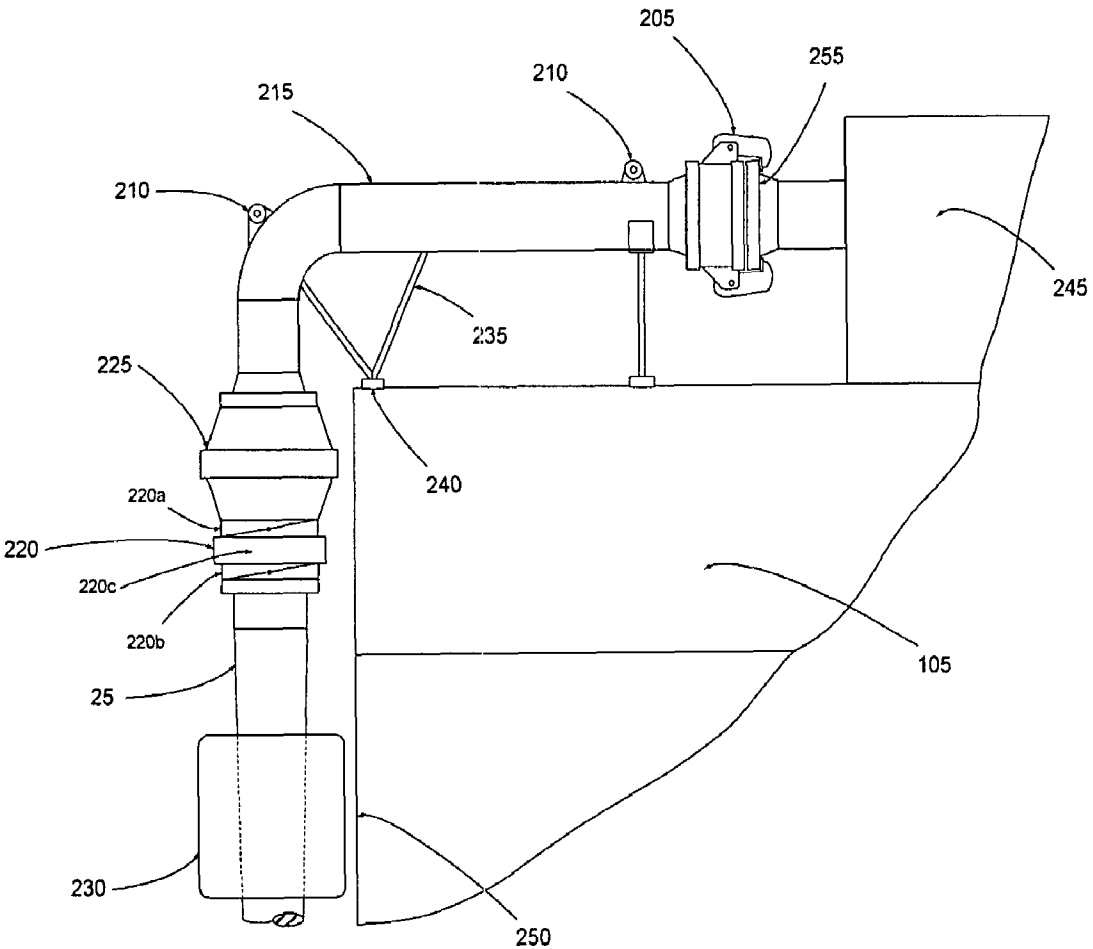
FIG. 3 illustrates the details of a connection means for connecting the conduit to the transport vessel. The various elements shown in FIG. 3 serve to improve the safety of the fluid transfer system and to protect the conduit from damage, while also allowing connection to a standard LNG transport vessel while minimizing any required modifications to the vessel.

The embodiment illustrated in FIG. 3 is a flexible conduit system comprising the flexible conduit with several connections. Transport vessels of the type used for LNG service normally do not provide connectors which overhang the side of the vessel. In order to maintain the conduit of the invention in a catenary form, with ends in essentially vertical configuration, a pipe spool (215) may be included. A pipe spool is a hardened piece which also permits the conduit to avoid contact with, and suffering abrasion damage from, the vessel. The pipe spool illustrated in FIG. 3 has a 90 degree bend. Other pipe spools providing a bend to any suitable angle, from 0 degrees to nearly 180 degrees, may also be useful in specific applications.

The embodiment illustrated in FIG. 3 further provides a quick connect/disconnect coupling (205) for quickly forming leak-tight connection between the conduit and the transfer manifold. FIG. 3 further shows an emergency release system (220), comprising a quick-closing valve (220*a*) & (220*b*), such as a ball valve or butterfly valve, on either side of a quick release mechanism. For emergency situations, the quick-closing valves are closed and the quick release mechanism (220*c*) is activated to separate the conduit from the connection means. This action mitigates potential damage to the conduit while minimizing the amount of cryogenic fluid spilled during an emergency event.

FIG. 3 further shows a swivel connector (225), preferably a cryogenic swivel, to permit either vessel to rotate relative to the conduit, in part to relieve torsion stresses within the hose during use in rough seas. The swivel connector is effectively two conduits connected through a leak-tight means for permitting one conduit to rotate around the axis of the connector relative to the other conduit of the connector, without applying undue torsion stress to the connector.

As shown in FIG. 3, the conduit (25) is further protected from contacting the side (250) of the vessel (105) by one or more flotation bumpers 230.

Figure 4:
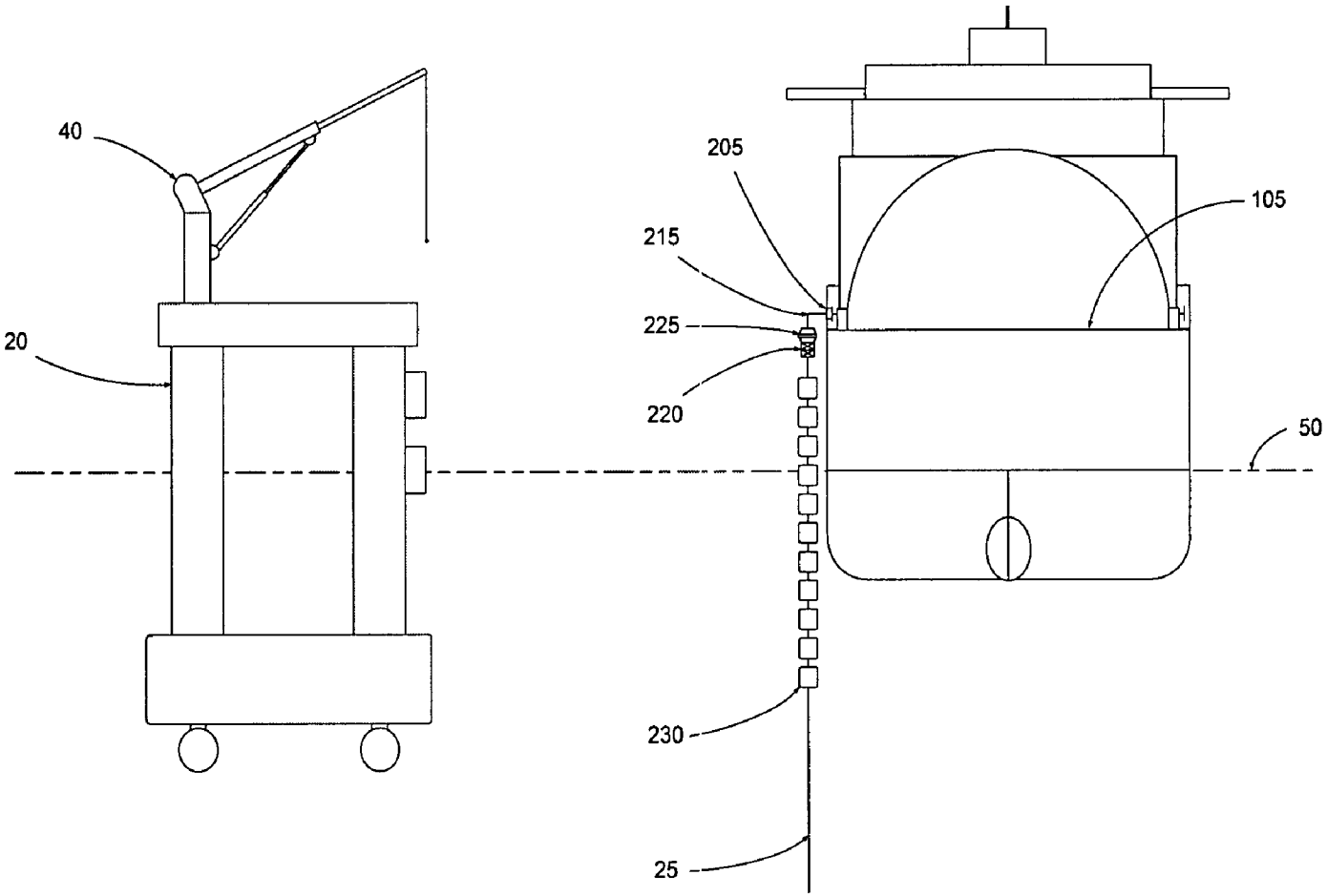
FIG. 4 further illustrates the method by which the conduit is connected to the transport vessel.

Further reference is made to FIG. 3 with FIG. 4 to illustrate connecting the conduit to the transport vessel. As described above, the second end of the conduit (25) with the associated connection means is supported on the conduit transfer vessel (20). The transfer vessel is moved up to the transport vessel (105), and the associated crane lifts the conduit by means of the lifting eyes (210), as shown in FIG. 3. When the conduit is in the vicinity of the manifold flange on the transport vessel (105), the stab-in support structure point (235) on the connection means are inserted into the stab-in guide (240). With the connection means now partially resting on the stab-in guide, the connection means is rotated and the quick connect/disconnect coupling (205) on the end of the connection means is connected to the floating transport vessel manifold flange (255), which is part of the transport vessel transfer manifold (245). When the connection between the manifold flange on the ship and the connection means on the conduit is made, the conduit transfer vessel (20) is moved aside and transfer of the cryogenic liquid may begin. During transfer of fluid, the conduit is protected from mechanical damage and abrasion with the side of the ship by floatation bumpers (230) which are distributed along a length of the conduit near the second end.

Figure 5:
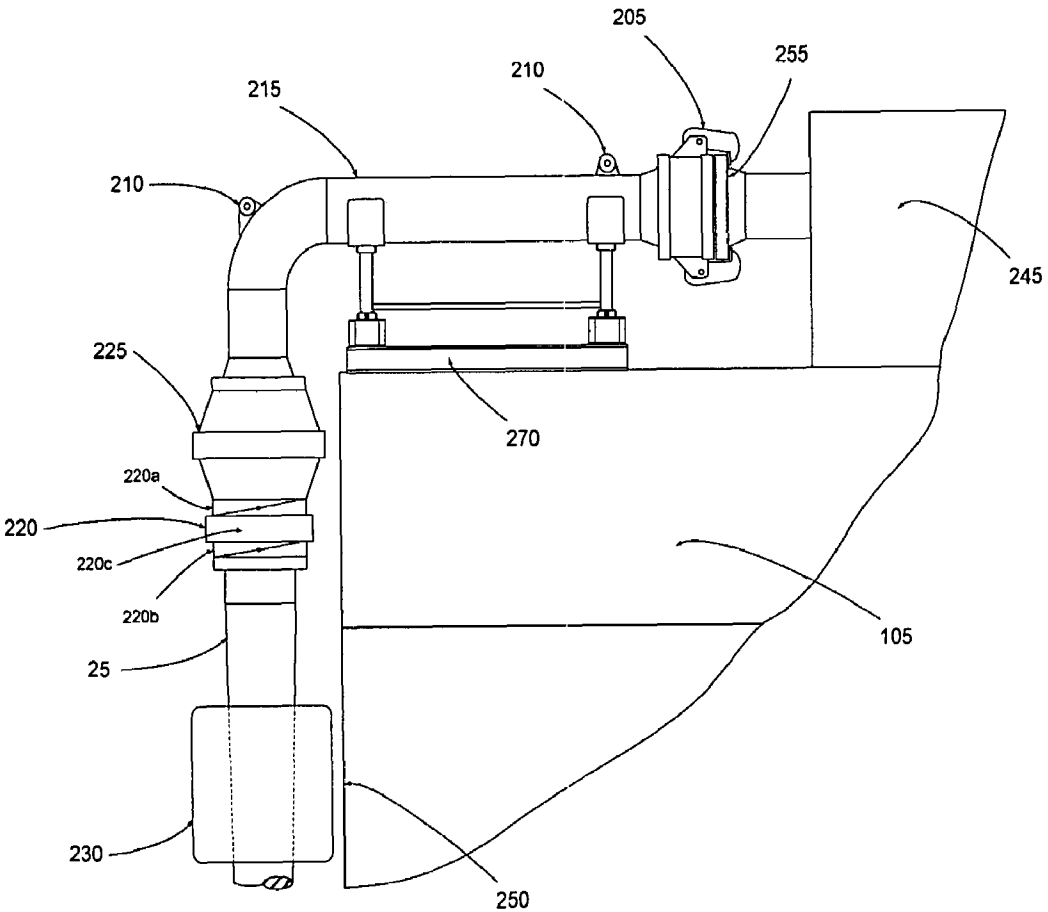
FIG. 5 further illustrates another method by which the conduit is connected to the transport vessel.

In another embodiment, illustrated in FIG. 5, an alignment and support skid (270) could be employed to align and support the conduit (25) with the associated connection means on the deck of the floating transport vessel (105). Although dimensional standards are in place from IMO and SIGTTO for the delivery manifold on transport vessels, variations in the centerline dimensions (horizontal spacing) and the elevation of the manifold flanges are allowed. Thus, some means of adjustment is needed to facilitate the alignment of the conduit pipe spool (215) and the connection means to the flange of the transport vessel delivery manifold (245). The alignment and support skid includes features to adjust the centerline dimensions and elevation of the conduit pipe spools, thus providing the capability to match the particular manifold arrangement of the transport vessel at hand. Prior to use the alignment and support skid is dimensionally configured, then moved to and set on the deck of the transport vessel by the conduit transfer crane (40) on the conduit transfer vessel (20). Each conduit means is then lifted by the crane and set into the corresponding slot in the alignment and support skid. Final adjustments can then be made to align the conduit pipe spool to the transport vessel manifold flange (255) and engage the quick connect/disconnect coupling, thus connecting the conduit means to the transport vessel. It is also envisioned that the alignment and support skid will serve to distribute structural loadings more efficiently to the manifold deck of the floating transport vessel (105) thus minimizing modifications to its structure.

When transfer of cryogenic fluid is complete, the conduit is removed in a reverse of the steps described above. Thus, the crane (40) is positioned to support the weight of the conduit and connection means by attachment to the lifting eyes (210). The quick connect/disconnect coupling (205) is released and the connection means and conduit are swung out of the way of the transport vessel and returned to the support on the conduit transfer vessel. The transfer vessel then moves away from the transport vessel, to permit the transport vessel to move from the area and return for another load of cryogenic fluid.

What is claimed is:

1. A process for transferring a cryogenic fluid from a first vessel to a second vessel, comprising:

a. providing a cryogenic fluid transfer assembly having:
   i. at least one pipe spool supported on a floating conduit transfer vessel; and
   ii. at least one conduit having a first end which is swivably connected to the pipe spool, and a second end which is swivably connected to a second vessel; and b. transferring the at least one pipe spool to a first vessel, and connecting the pipe spool to a connection means comprising a quick release connection on the first vessel, wherein the conduit is maintained in a catenary configuration between the second vessel and the first vessel with only the first and second ends of the conduit exposed above water.

2. The process of claim 1, further comprising passing a cryogenic fluid through the cryogenic fluid transfer assembly between the first vessel and the second vessel.

3. The process of claim 1, wherein the conduit is a flexible catenary hose.

4. A process for transferring a cryogenic fluid between a first vessel and a second vessel, comprising:

a. providing a flexible conduit, having a catenary shape, the conduit being supported at a first end by a first vessel and at a second end by a second vessel, wherein the conduit is substantially submerged in the body of water;

b. transferring the second end of the flexible conduit from the second vessel to a third vessel;

c. connecting the second end of the flexible conduit to the third vessel, wherein the flexible conduit is maintained in a catenary configuration between the first vessel and the third vessel with only the first and second ends of the flexible conduit exposed above water; and d. passing a cryogenic fluid through the flexible conduit between the first vessel and the third vessel.

5. The process of claim 4, wherein the first vessel is a storage vessel, the second vessel is a conduit transfer vessel, and the third vessel is a transport vessel.

6. The process of claim 4, wherein the flexible conduit is selectively weighted such that the conduit is maintained in a catenary configuration during transfer of the cryogenic fluid through the conduit.

7. A process for transferring a cryogenic fluid between a first vessel and a second vessel, comprising:

a. providing a flexible conduit system which includes a flexible conduit, having a catenary configuration, and further having a first end and a second end, and at least one connection means connected to the second end, wherein the flexible conduit is substantially submerged in a body of water;

b. supporting the first end of the flexible conduit on a first vessel, c. supporting the second end of the flexible conduit on a second vessel;

d. transferring the second end of the flexible conduit from the second vessel to a third vessel;

e. connecting the second end of the flexible conduit to the third vessel via the connection means, wherein the flexible conduit is maintained in a catenary configuration between the first vessel and the third vessel with only the first and second ends of the flexible conduit exposed above water; and f. passing a cryogenic fluid through the flexible conduit between the first vessel and the third vessel.

8. The process of claim 4, wherein the cryogenic fluid is liquefied natural gas.

9. The process of claim 7, wherein the cryogenic fluid is liquefied natural gas.

10. The process of claim 7, wherein the cryogenic fluid is liquefied heavy gas.

11. The process of claim 7, wherein the cryogenic fluid is liquefied petroleum gas.

* * * * *